US012357900B2

(12) United States Patent
Garbis

(10) Patent No.: US 12,357,900 B2
(45) Date of Patent: Jul. 15, 2025

(54) THERMOSENSITIVE MOUTH SHIELD

(71) Applicant: GBURG SPORTS, LLC, West Friendship, MD (US)

(72) Inventor: George Garbis, West Friendship, MD (US)

(73) Assignee: G'BURG SPORTS, LLC, West Friendship, MD (US)

( * ) Notice: Subject to any disclaimer, the term of this patent is extended or adjusted under 35 U.S.C. 154(b) by 352 days.

(21) Appl. No.: 17/988,417

(22) Filed: Nov. 16, 2022

(65) Prior Publication Data

US 2023/0158393 A1 May 25, 2023

Related U.S. Application Data

(60) Provisional application No. 63/281,297, filed on Nov. 19, 2021.

(51) Int. Cl.
*A63B 71/08* (2006.01)

(52) U.S. Cl.
CPC ..... *A63B 71/085* (2013.01); *A63B 2209/14* (2013.01); *A63B 2230/50* (2013.01)

(58) Field of Classification Search
CPC ..... A63B 71/08–10; A63B 2209/14; A63B 2230/50; A61F 5/56–566; A61C 7/08; A61C 7/36; A61C 19/04; A61C 19/06–08
See application file for complete search history.

(56) References Cited

U.S. PATENT DOCUMENTS

| | | | | |
|---|---|---|---|---|
| 3,089,487 | A * | 5/1963 | Enicks | A63B 71/085 128/861 |
| 5,031,638 | A * | 7/1991 | Castaldi | A63B 71/085 128/862 |
| 6,274,122 | B1 * | 8/2001 | McLaughlin | A61Q 11/00 424/53 |
| 6,607,382 | B1 * | 8/2003 | Kuo | A61P 1/02 433/80 |
| 2006/0237020 | A1 * | 10/2006 | Morgan | A63B 71/085 128/862 |
| 2008/0295850 | A1 * | 12/2008 | Lesniak | A61F 5/566 523/109 |
| 2011/0005531 | A1 * | 1/2011 | Manzo | A63B 71/085 128/207.14 |
| 2013/0247922 | A1 * | 9/2013 | Kamradt | A63B 71/085 128/862 |
| 2019/0091060 | A1 * | 3/2019 | Shah | A61F 5/566 |

* cited by examiner

*Primary Examiner* — Michelle J Lee
(74) *Attorney, Agent, or Firm* — Sughrue Mion, PLLC

(57) ABSTRACT

Provided is a mouth guard having an outer layer and inner layer and a foam insert layer configured to absorb impact forces. The insert layer is softer than and thicker than the outer layer and inner layer to provide increased force absorption. The outer layer includes a thermos-chromic material that changes color and transparency to provide indication of temperature inside of a user's mouth.

7 Claims, 12 Drawing Sheets

TOP VIEW

BOTTOM VIEW

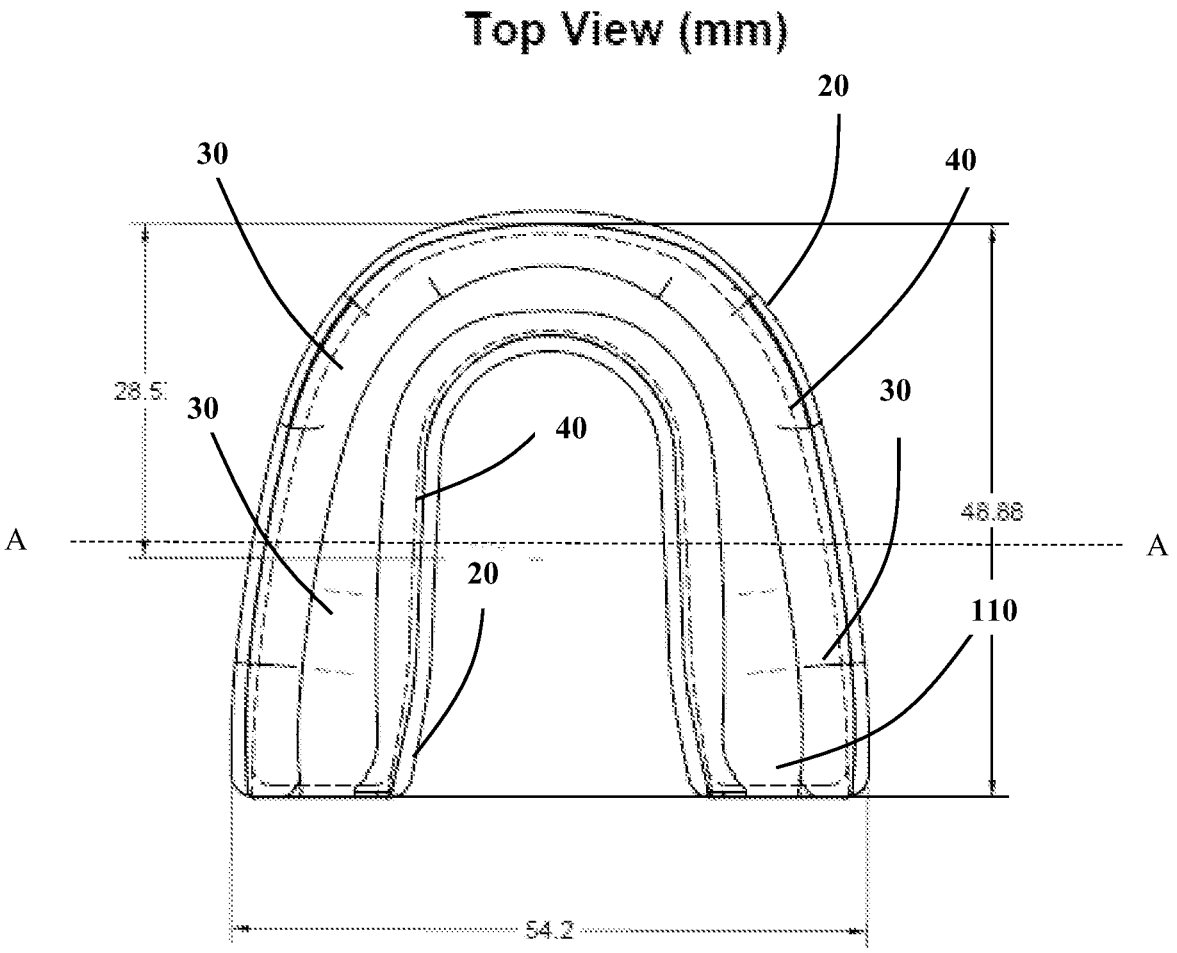
FIG. 1A – TOP VIEW

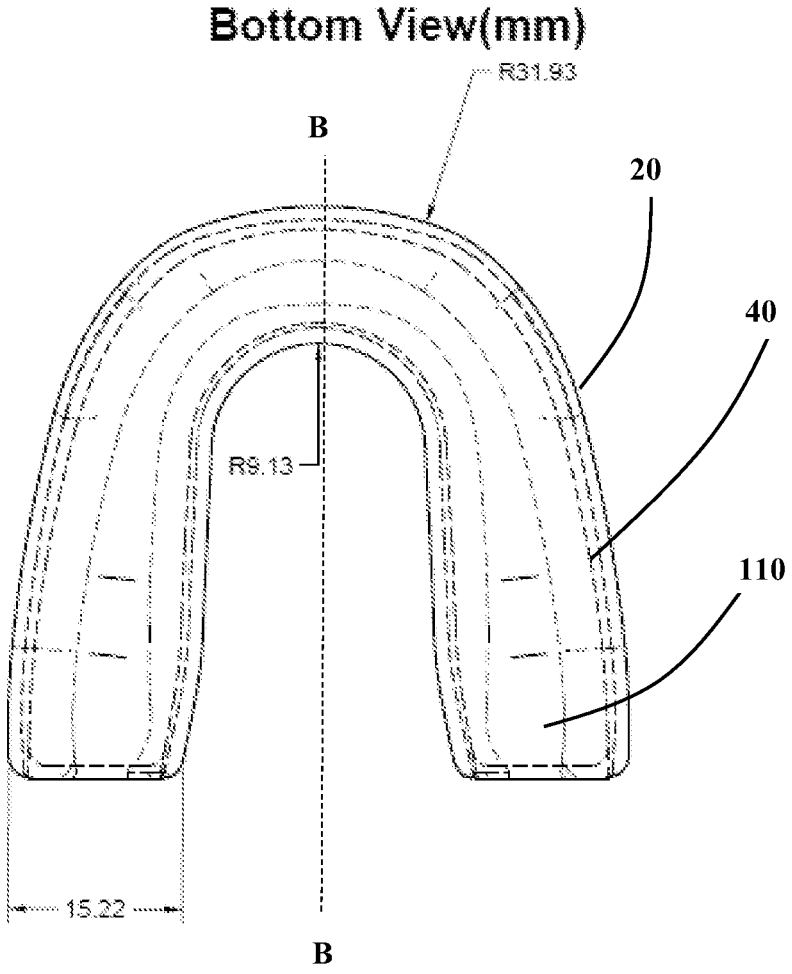
FIG. 1B – BOTTOM VIEW

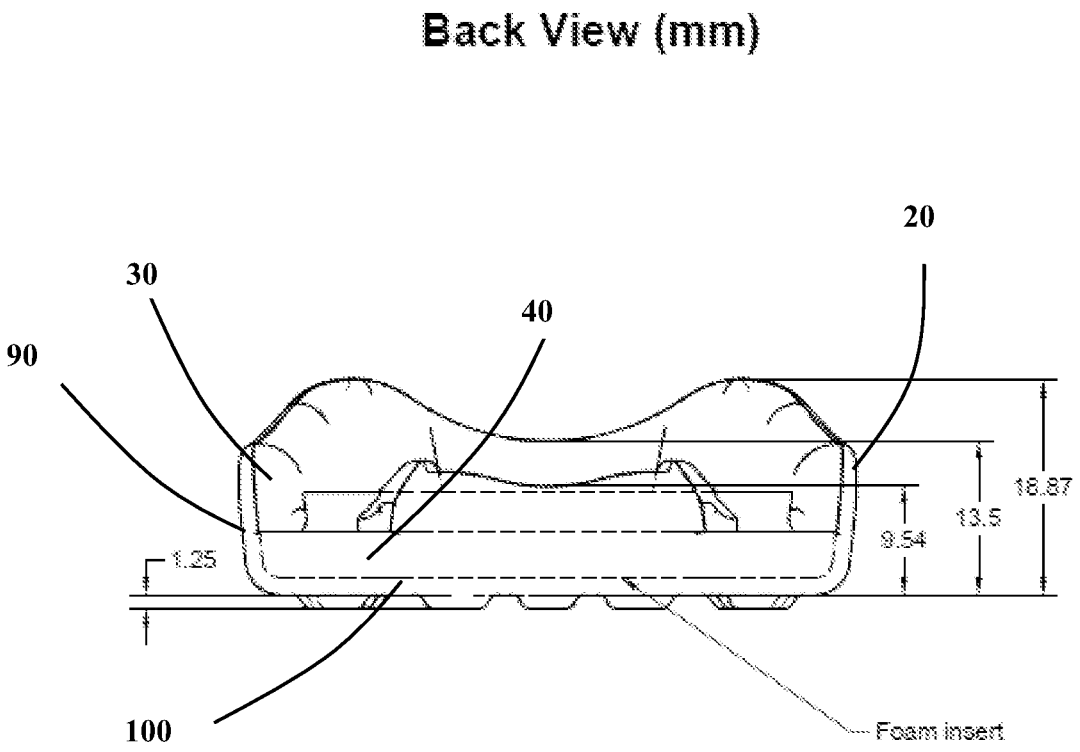
FIG. 2A – REAR VIEW

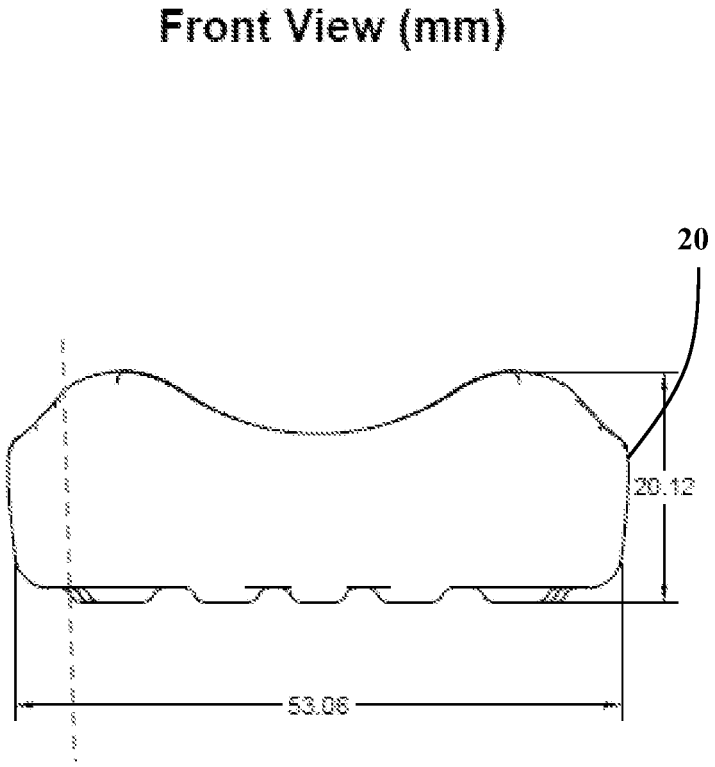
FIG. 2B – FRONT VIEW

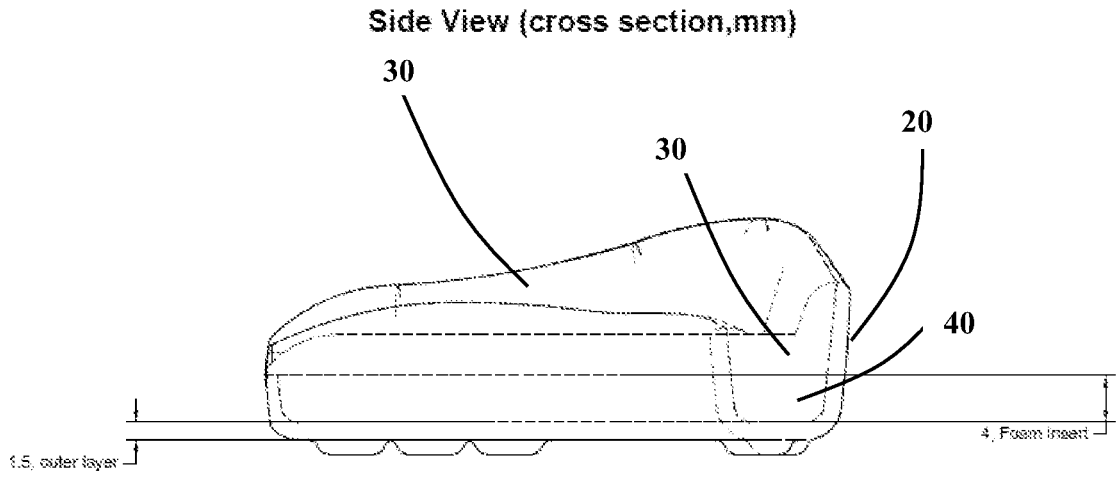
FIG. 3 – Side Cross Sectional View

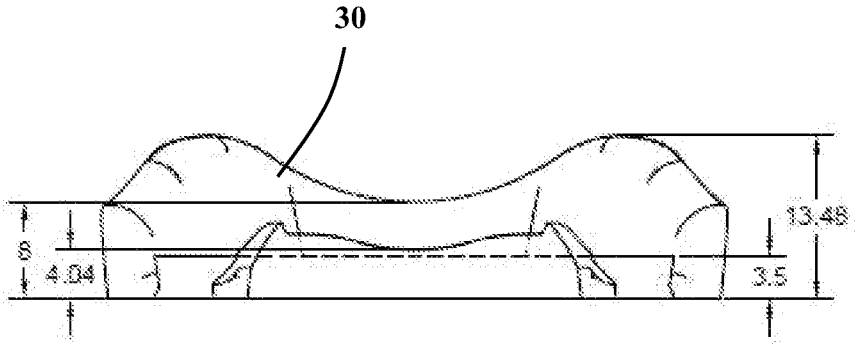
FIG. 4A – Inner Layer Rear View
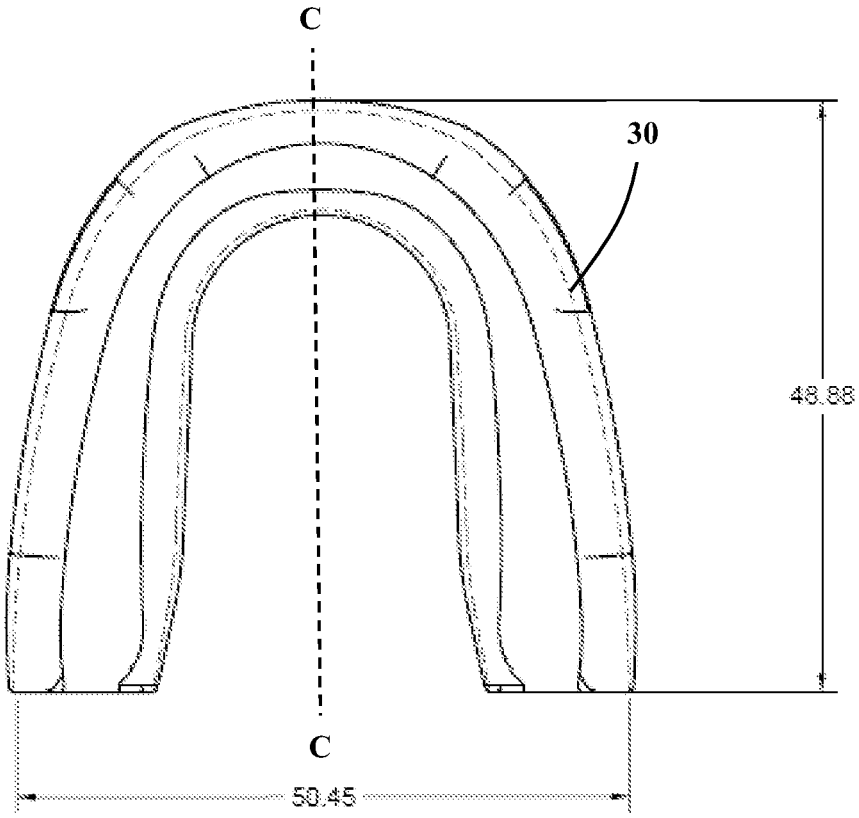
FIG. 4B – Inner Layer Top View

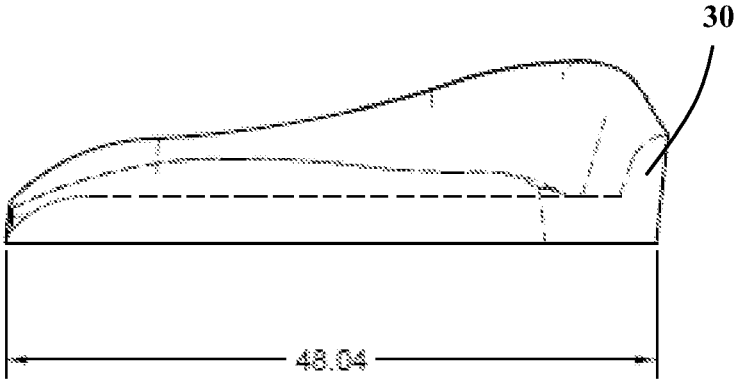
FIG. 4C – Inner Layer Cross-Sectional View of FIG. 4B
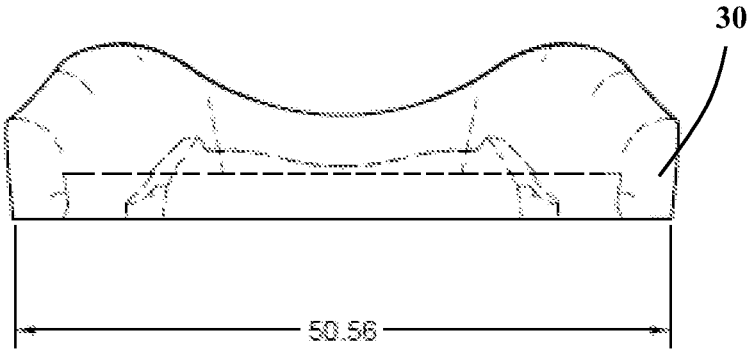
FIG. 4D – Inner Layer Rear View

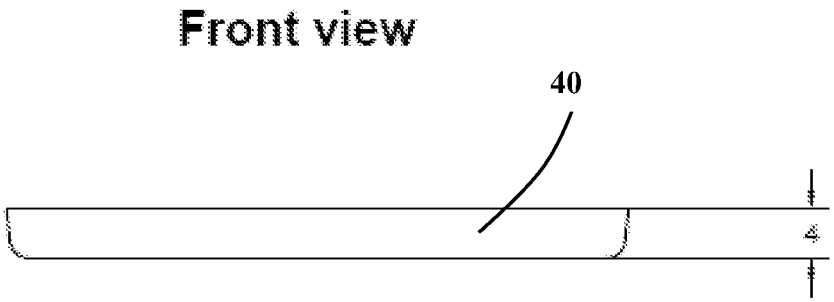
FIG. 5A – Insert Front View
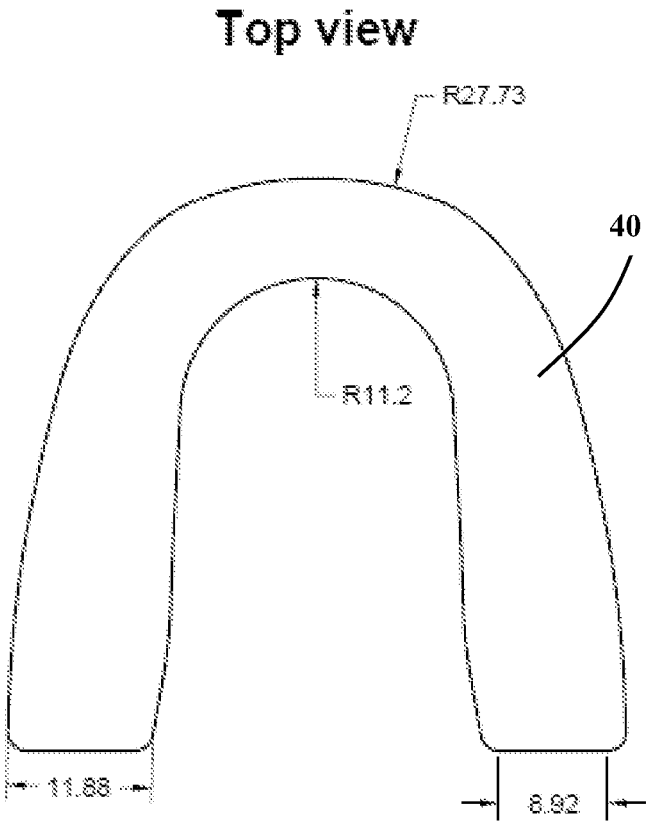
FIG. 5B – Insert Top View

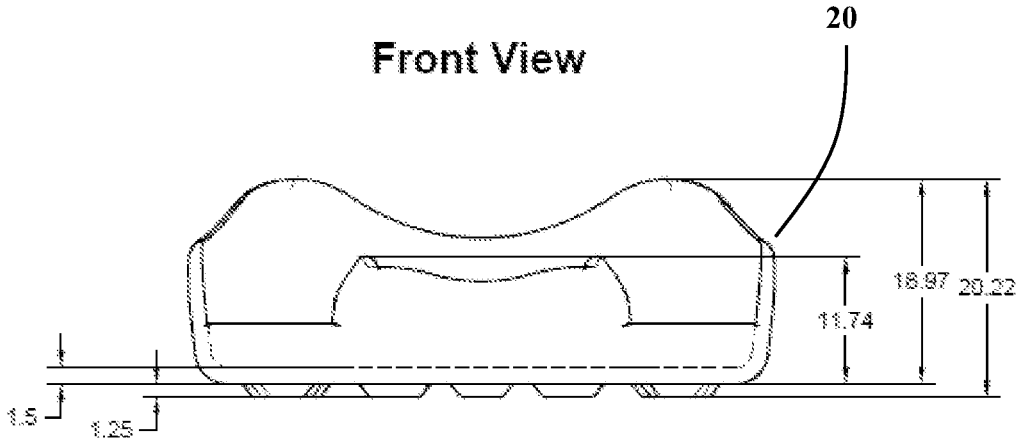
FIG. 6A – Outer Layer Rear View
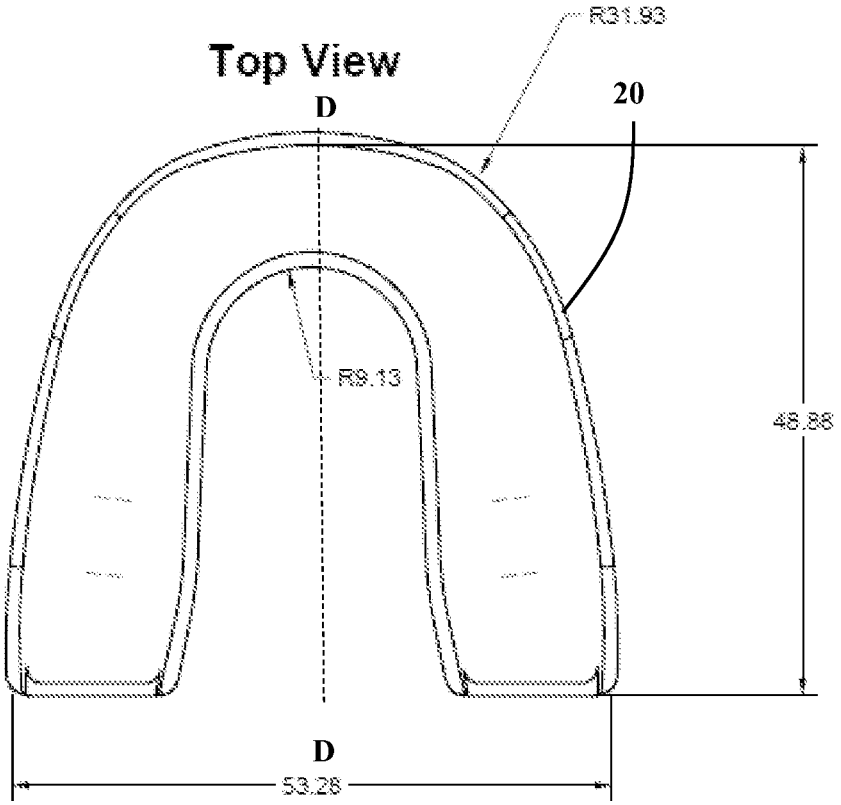
FIG. 6B – Outer Layer Top View

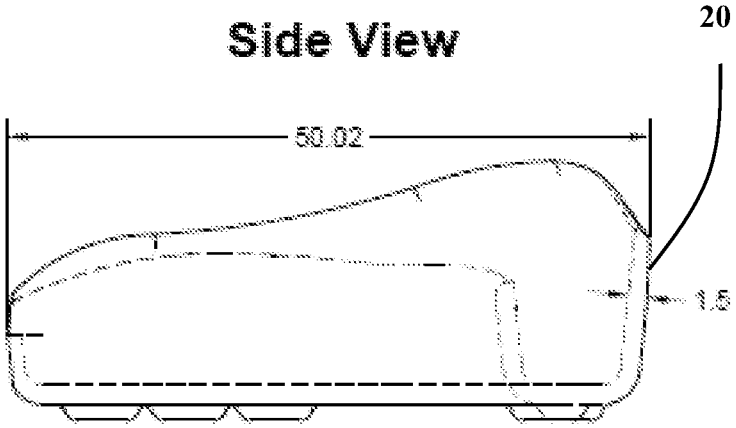
FIG. 6C – Outer Layer Cross-Sectional View (Centerline of FIG. 6B)

THERMOSENSITIVE MOUTH SHIELD

CROSS-REFERENCE TO RELATED APPLICATIONS

This application is claims the benefit of priority from U.S. Provisional Application No. 63/281,297, filed Nov. 19, 2021, the entire contents of which are incorporated herein by reference.

BACKGROUND OF THE DISCLOSURE

Typically, in physical sports such as football, hockey, lacrosse, etc., traumatic mouth and head injuries result from collisions on the field of play. These injuries occur despite these athletes wearing conventional "boil and bite" shields. Much attention is directed to monitoring athletes post-concussion and preventing participation until it has been determined the athlete ceases to show post-concussion effects. However, it is difficult to accurately assess the real damage incurred based on an athletes symptoms. Accordingly, there is a need to improve an athletes gear to prevent and/or minimize concussions.

Another problem encountered in these physical sport activities is over-heating during practice and games that can lead to heat stroke and deaths. Certain sports tend to reward toughness and many of these sports foster a warrior mentality. These athletes often are accompanied by hard working, never quit attitudes. Heat acclimation can vary significantly, thus, some participants can tolerate a higher level of activity whereas others cannot. Therefore, different participants may require close monitoring, but identifying which participants require monitoring is not well defined. Exertional heat stroke is the leading cause of death in young athletes each year (CDC) with 28 deaths from Accordingly, there is a need for alternative and reliable indicators for athletes entering dangerous levels of overheating. Typically, in physical sports such as football, hockey, lacrosse, etc., traumatic mouth and head injuries result from collisions on the field of play. These injuries occur despite these athletes wearing conventional "boil and bite" shields. Much attention is directed to monitoring athletes post-concussion and preventing participation until it has been determined the athlete ceases to show post-concussion effects. However, it is difficult to accurately assess the real damage incurred based on an athletes symptoms. Accordingly, there is a need to improve an athletes gear to prevent and/or minimize concussions.

SUMMARY OF THE APPLICATION

The aspects of the present disclosure relate to an athletic mouth shield designed to prevent or reduce these injuries by providing a superior ability to absorbing impact than the typical over-the-counter, "boil-and —bite" mouth shields currently available in most stores and on-line. In addition, according to another aspect the mouth shield, through thermo-chromic technology is designed to provide an external warning that an athlete is experiencing extreme heat levels that may require immediate action to prevent further injury or death. The mouth shield may also include a modified helmet strap that will also double as a holder during the boil and bite process.

According to another aspect, the mouth shield is configured to protect teeth and surrounding oral structures by introducing a more effective way to absorb energy from any activity that may lead to head, teeth and jaw trauma. The absorbing of forces will also assist in decreasing the severity of possible concussions from head trauma.

According to one aspect, the thermo-chromic portions are positioned to contact the gingiva or contact the adjacent tissue between the gingiva and the inner surface of the wearers lip, when the casing in inserted in the wearer's mouth. The mouth shield may comprise a thermo-chromic insert, injection, or material in itself, which will change color at a temperature that indicates an increased and dangerous core body temperature of the wearer. Studies show that heat exhaustion and heat stroke begins when the core body temperature of an athlete reaches 102 degrees F. Between 100 and104 F this thermo-chromic material will change enough to provide a noticeable, different color, thus alerting the wearer, coach, parent, or any other individual who notices that the wearer has an increase in core body temperature.

According to another aspect, the mouth guard includes an outer layer that forms a lowermost layer and side walls defining a U-shape; an insert layer formed of a shock absorbing foam disposed on an upper surface of the outer layer and extending between the sidewalls of the outer layer; and an inner layer formed on the insert layer and extending between between the sidewalls of the outer layer. The outer layer is formed of a material harder than the insert layer and the inner layer, and the insert layer is formed of a material softer than the outer layer and the inner layer to absorb forces exerted on the outer layer and the inner layer.

According to another aspect, the outer layer includes a thermo-chromic material configured to change color in response to the outer layer reaching a temperature in excess of 100 degrees F. The thermos-chromic material may be configured to change the color from a dark color to a transparent or semitransparent material, and the insert layer is formed of a bright color whereby the bright color is visible through the outer layer when semitransparent due to the temperature in excess of 100 degrees F. The inner layer may abut the outer layer at a front portion of the mouth guard configured to fit the front teeth of the user and be exposed through a user's mouth when the outer layer becomes transparent, or semi-transparent.

According to another aspect, the insert layer is thicker than the inner layer and the outer layer in the bit direction. The thickness of the outer layer is within the range of 1-2 mm, the thickness of the insert layer is within the range of 3.5-4.4 mm, and the thickness of the inner layer is within the range of 3.3-3.8 mm.

According to another aspect, the outer layer is configured to change from a dark color to a transparent color and has a thickness in the range of 1-1.5 mm along a front portion of the sidewall configured to face opposite a user's teeth, and the inner layer abuts the outer layer inside the front portion and has a bright color, and wherein the bright color and thickness of the front portion are configure to show the bright color when the temperature of the outer layer exceeds at temperature within the range of 100-102 degrees F.

According to another aspect, the outer layer and the inner layer comprise an elastomeric polymer; and the insert layer is formed of a foam material.

BRIEF DESCRIPTION OF THE DRAWINGS

The above and other features and aspects of the present invention will become more apparent by describing non-limiting exemplary embodiments thereof with reference to the attached drawings in which show some configurations that provide better impact absorption as well as heat stress conditions of a participant.

FIG. 1A is a top view of a mouth guard in accord with an embodiment;

FIG. 1B is a bottom view of the mouth guard;

FIG. 2A is a rear view of the mouth guard taken along the cross section A-A of FIG. 1A;

FIG. 2B is a front view of the mouth guard;

FIG. 3 is a side cross sectional view taken from section B-B of FIG. 1B;

FIG. 4A is a rear view of a top layer of the mouth guard;

FIG. 4B is a top view of the top layer of the mouth guard;

FIG. 4C is a cross-section view of from section C-C of FIG. 4B;

FIG. 4D is a rear view of the top layer of the mouth guard;

FIG. 5A is a front view of an insert layer of the mouth guard;

FIG. 5B is a top view of the insert layer of the mouth guard;

FIG. 6A is a rear view of an outer layer of the mouth guard;

FIG. 6B is a top view of the outer layer of the mouth guard;

FIG. 6C is a cross section view of from section D-D of FIG. 6B;

DETAILED DESCRIPTION OF THE EXEMPLARY EMBODIMENTS

Figure 7A:
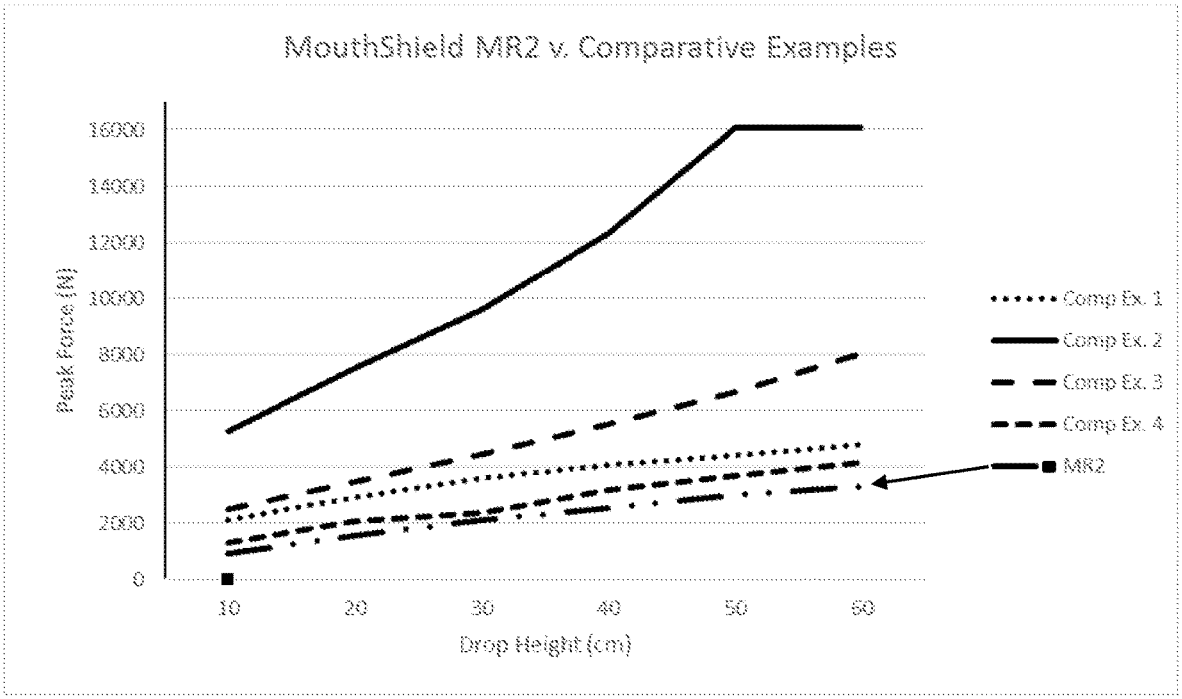
FIG. 7A is a graph showing force absorption characteristics of an embodiment compared to comparative examples.
Figure 7B:
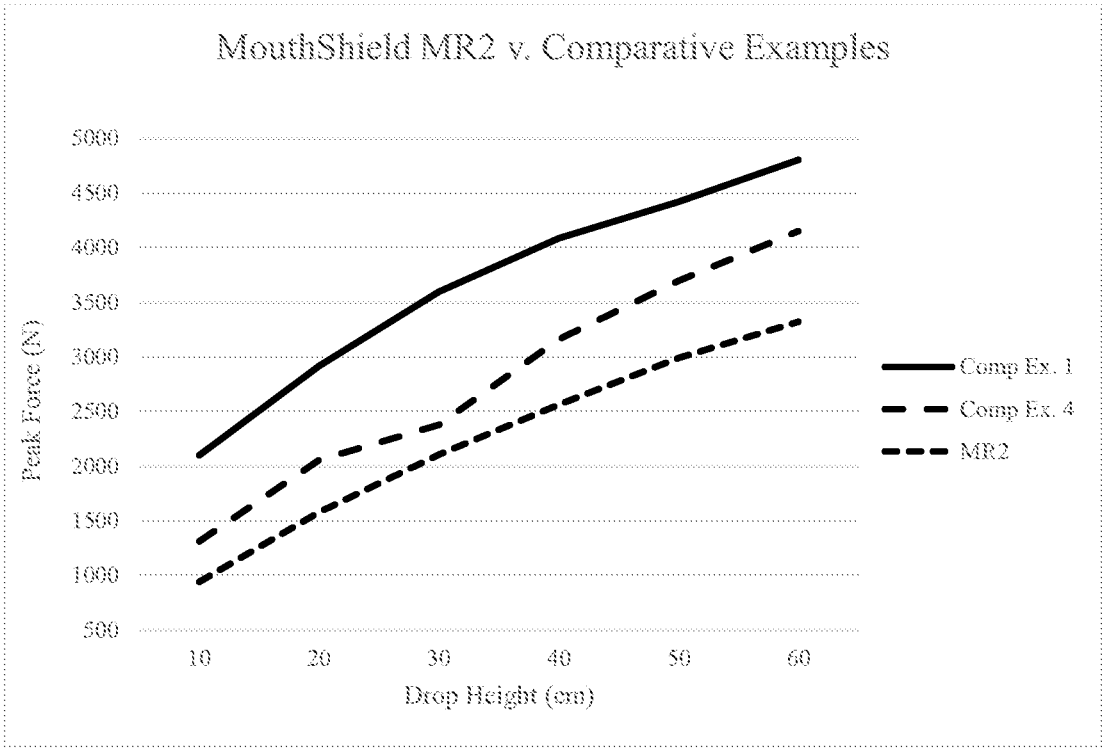
FIG. 7B is aother graph showing force absorption characteristics of an embodiment compared to comparative example.

In general terms this mouth guard has two main components that differ from those on the current market. The first is a material that is embedded in the guard to allow for better shock absorption. The guard will be fabricated using a thermoplastic material and a material that has a higher modulus of elasticity and higher compressive strength embedded into the thermoplastic material. This will increase the absorption of impacts and minimizing traumatic injury to the mouth, teeth and decreasing concussions from certain vectors. The second component is a thermo-indicator that will alert the athlete, coach, or trainer that athlete's body temperature may be increasing. The thermo-indicator will be embedded into an outer layer of the mouth guard to function in combination with the inner layer.

The mouth guard has a U-shaped structure corresponding to the upper teeth of a user and configured to be fitted to the upper teeth of a user using a "boil-and-bite" method or a catalyst and base impression type fit. The mouth guard has a three layer construction and made of harder thermoplastic materials in combination with a softer shock absorbing material sandwiched between upper and lower layers configured to contact the user's teeth.

Through research and development it has been concluded that various aspects of the present disclosure consistently absorb forces better than comparative mouth guards. The reason for the greater amount of shock absorption is due to the addition of the softer insert layer. This layer helps to absorb the impact more efficiently and then return to its natural form. It also absorbs higher forces while using a thinner profile as compared to the conventional mouth guards. In addition, most boil and bites guards are ill-fitting and difficult to form to the teeth. Another aspect of the described embodiments is designed to improve the fit and forming aspects to approach these features of associated with a custom dentist made guard.

In general terms, this mouth guard has at least two main aspects that differ from those on the current market. The first is a material that is embedded in the guard to allow for better shock absorption—the softer insert layer. The guard also includes harder outer layers sandwiching the embedded softer material (insert layer) that have a higher modulus of elasticity and higher compressive strength to provide structural characteristics to protect a user's teeth. This unique combination can increase the absorption of impacts and minimize traumatic injury to the mouth, teeth by decreasing concussion impacts from certain vectors. The second aspect is a thermo-indicator that will alert the athlete, coach, or trainer when an athlete's mouth temperature increases above normal levels to provide a potential indicator of possible heat stress. The thermo-indicator according to one aspect will be embedded into the outer layer of the mouth guard by using thermo-chromic technology within the outer layer to provide a color change with temperature. However, according to yet another aspect, the outer layer and inner layer can be configured to function together to provide effective color changing characteristics. According to this aspect, the outer layer relies on thermos-chromic technology to change the dark outer layer to become transparent or semi-transparent at increasing temperature to permit a bright colored inner layer to show through as an indicator.

The mouth guard described is a U-shaped guard to contour the user's teeth that will be fitted by the athlete using a "boil-and-bite" method. The mouth guard has a three layer construction and made of thermoplastic material with a material of higher compressive strength embedded along the biting surface of the guard made of any, non-toxic material that will absorb forces and a softer insert layer to improve force absorption. On suitable material is polyethylene XP-80R foam. This material was tested and proven against the main boil-and-bite guards on the market.

Through research and development it has been concluded that various aspects of the present disclosure are consistently better at absorbing forces than the typical mouth guards on the market (comparative examples). The reason for the greater amount of shock absorbing is due to the addition of a foam insert layer. This insert layer helps to absorb the impact more efficiently. It also absorbs force with a thinner product than the competition. In addition, most boil and bites guards are ill-fitting and difficult to form to the teeth. The present design makes it easy to fit and form almost as well as a custom dentist made guard.

As shown in FIGS. 1A-2B, the mouth guard 10 has a U-shaped profile to fit to a user's teeth. The mouth guard 10 comprises three different layers. These include an outer layer 20 that is formed as an outermost portion that is separated from a user's upper teeth by both the inner layer 30 and the insert layer 40. The outer layer 20 directly contacts a user's lower teeth. The inner layer 30 is formed with a tooth recess 50 that is configured to fit around the bottom and sides of a user's upper teeth. This portion is configured to be fitted to the user's teeth using a "boil and bite" method. The outer layer 20 is configured to contact the user's lower, and within the inner layer 30 and the outer layer 20, an insert layer 40 is disposed to improve the force and torque absorption characteristics of the mouth guard 10.

As shown in FIGS. 1A-3A and 6A-6C, the outer layer 20 includes a curved front portion 60 that connects two side portions 70. The mouth guards are configured in size to fit conform to an outer range of the upper tooth profile of typical users. This outer layer 20 has a height that is a maximum at a front portion 60 adjacent each side portion 70 of the outer layer 20, and reduced heights at a front center of the outer layer 20 and at rear portions of the side portions 70 of the outer layer 20.

In this embodiment, the outer layer 20 of the mouth guard is made of 80% ethylene vinyl acetate (EVA) and 20% Elastollan, with an additional thermo-chromic additive at 4-8% of the EVA/Elastollan mix to provide color changing attributes. In a preferred embodiment, LCR Hallcrest thermobatch is used as the thermos-chromic additive. As a result, the outer layer 20 changes from an opaque color to more transparent material to enable not only a change in color, but also to permit the color of the inner layer to be visible therethrough. This outer layer 20 is formed to have a thinner cross section as compared to the insert layer 40 and the inner layer 30. The thickness of the outer layer is about 1.5 mm measured perpendicular to the bite area surfaces 110 (where all thicknesses are measured), but may range from 1-2 mm. The Elastollan and EVA provide a less ductile structure that retains more integrity during the forming process (not as moldable as the inner layer), but has a softer feel at normal temperatures. This softer feel is a result of adding the Elastollan, which is a softer material than EVA, which gives the guard a softer feel and aids in eliminating any possible sharp edges to reduce the risk for cuts on the gums.

The outer layer 20 also enables a thermal indication of a user's mouth temperature to provide a warning that a user may be experience heat stress or otherwise an elevated body temperature. In a preferred embodiment, LCR Hallcrest thermobatch is used as the thermos-chromic additive. As a result, the outer layer 20 changes from an opaque color to more transparent material to enable not only a change in color, but also to permit the color of the inner layer to be visible therethrough.

Temperature data was taken from 500 persons of varying ages and genders using a digital thermometer on each patient under the lip above the front teeth, under the cheek on the side of the mouth near the molars and the standard under the tongue. The variation between under the tongue and the other areas was 2 degrees F. In other words, when the temperature under the tongue was 98.7 degrees F., the temp under the lip and side of cheek was around 96.7 degrees F. Therefore, the thermos-chromic effects create a visible color change that becomes more prominent above 100 degrees F. and increases at more elevated temperatures. This color change can indicate need for the athlete to be more closely examined with a thermometer and for any possible symptoms.

To provide this thermal indication, a color-changing pigment is added the EVA and Elastollan composition and is designed to change color characteristics temperature around 38-39° C. (100-102.2° F.). In a preferred embodiment, the pigment added is LCR Hallcrest Thermobatch (37 deg C-39 deg C). The color-changing pigment is added between 4%-8% in the outer layer, but more preferably 8%. The amount used is based on what is required to change the EVA and Elastollan composition into a solid color so that the indicator provides a color difference when temperatures activates the pigment.

In this embodiment, this amount of pigment makes the outer layer a solid color (opaque) at lower temperatures, such as black, however any color may be used. When the internal oral temperature reaches this threshold level of temperature, the outer layer 20 of the guard will change to a clear color to thereby change color, and may also change to the extent to expose the color of the inner layer 30. This color change may warn coaches, trainers, and players of a possible heat injury. While this embodiment relies on a material added to the outer layer composition, alternatively, a thermo-chromic insert may be added to at least a front portion of the outer layer 20 to provide temperature indications. Another variation may be to coat the outer layer 20 with a thermos-chromic paint, or the like.

Next, the mouth guard includes an insert layer 40 disposed on a bottom wall 100 and between the side walls 90 of the outer layer 20, and below the inner layer 30 so as to be sandwiched between the outer and inner layers. FIGS. 2A, 3A and 5A-5B illustrate the structure of the insert layer 40. This insert layer 40 is a foam layer configured to absorb impact by compressing or deforming as a result of external forces. As shown in the figures, this insert layer 40 fits into the profile created by the sidewalls 90 of the outer layer 20, and has a constant thickness perpendicular to the bite area 110. In this embodiment, the material is a two-component polyurethane (Elastopan). This material is a shock absorbing foam. The thickness of the insert layer 40 can range from 3.5-4.4 mm, but is preferably 4 mm. This layer is softer than either the outer layer 20 or the inner layer 30 to provide shock absorbing characteristics.

As shown in FIGS.4A-4B, disposed on top of the insert layer 40 is an inner layer 30 that is configured to be conformable to a user's teeth. This layer has an upper surface with outer edges thicker than the central portions configured to align with a user's teeth. This layer is harder than both the outer layer 20 and the insert layer 40. In this embodiment, this layer is made of 100% EVA. This layer is configured to soften when the mouth guard 10 is boiled to enable a user to bite and profile the outer surface to confirm to the shape of the user's upper teeth. In view of this deformation and shaping during the fitting, this layer is thicker than the outer layer 20. In this embodiment, the thickness of the central portion of inner layer 30 in an upper direction is thicker than the other layers and is 3.5 mm, in this embodiment, but may ranges from 3.3 mm to 3.8 mm. This thickness provides enough material to permit an accurate and deep tooth impression. Accordingly, this minimum thickness in this layer before fitting to a user's teeth is 3.3 mm.

Additionally, the inner layer 30 defines a channel to which an upper row of the teeth can be fitted within a bite area 110. The inner layer 30 is a colored layer (not clear) in this embodiment to enable the color of this layer to show through the outer layer 20 when the outer layer's thermo-chromatic design changes color to the extent of becoming partially transparent as the user's temperature raises the temperature of this layer. This results in a relatively transparent outer layer 30. This effectuates a color change as the color of the inner layer 30 is configured be different than the color of the outer layer. In this embodiment, the color of the inner layer 30 is brighter than the original color of the outer layer 20 that is configured to transition from a dark color (black or dark blue) to a transparent material or semitransparent material due to the temperature change. In a preferred embodiment, the outer layer 20 is configured to be black at normal body temperatures, and to transition to a semi-transparent or transparent layer with increased temperature so that the effective change from black toward transparent enables an inner layer of red to be easily visible from the user's mount when wearing the mouth guard. This, in effect, provides a noticeable indicator to warn another that the user may be experiencing some heat stress. By using a bright color, when the outer layer turns clear (due to heat injury/illness) the color of the inner layer is more noticeable and act as a "warning" to coaches, trainers, etc. This layer contains the boil and bite aspect of the guard. As shown in FIG. 3, an upper portion of the outer layer 20 abuts the inner layer, thus, when the outer layer becomes transparent, the color of the inner layer 30 can show through the outer layer. While thermos-chromic materials used in the preferred embodiment have color transitions beginning below 100 degrees F. and continue to transition above 102 degrees F., the thickness of the front portion of the outer layer and the amount of thermos-chromic material are adjusted to enable recognition of a color change at the target oral temperature of 100-102 degrees, whereby enough of the inner layer's color can be transmitted through the outer layer. Thus, the thickness of the outer layer at 1.5 mm may be adjusted, but the adjustment must account for the amount of thermos-chromatic color change needed based on the thickness to effectuate a visual indication of a temperature change.

Impact Testing

Impact testing was performed on an mouth guard in accord with the present invention (labeled MR2) as well as four comparative examples. The thickness of the layers of the tested embodiment MR2 included an outer layer thickness of 1.5 mm, an insert layer of 4 mm, and an inner layer of 3.5 mm. The impacting testing was developed to test the vertical impact force absorption by each mouth guard. The structure of the mouth guards tested for comparison are described in the table below.

| Sample Numerical ID | Mouth Guard Structure |
|---|---|
| Comp. Ex. 1 | Single Layer—medium hardness |
| Comp. Ex. 2 | Single Layer—high hardness |
| Comp. Ex. 3 | Two layer—inner layer (top) softer than outer layer (bottom) |
| Comp. Ex. 4 | Three layer—hard inner layer, hard middle layer and harder outer layer |
| MR2 | Three layer—hard outer layer, soft middle layer and harder outer layer |

Embodiment 1 (MR 2) Details—thicknesses measured in the biting direction:

Inner Layer

Material—100% Elax EVA, Shore A 73

Thickness—3.5 mm

Insert Layer

Material—100% Elastopan 43040 [two-component polyurethane of Elastopan 43040R (polyols and additives) and Elastofoam 3120T Isocyanate (MDS based quasi-prepolymer)]Mix Ratio (Resin/Isocyanate): 100/51.6+/−1

Thickness—4 mm

Outer layer

Material—Elastollan BCF 35A12 PTSG (20%), shore A 37, and Elvax EVA (80%) shore A 72

Thickness—1.5 mm

The purpose of the impact test was to simulate an uppercut type force acting on each mouthpiece sample. The peak force recorded represents the amount of force transferred through the mouthpiece at various impact loads. The mouth guard is intended to absorb as much of the impact force as possible to reduce the force transferred to the user. Therefore, the lower the peak force, the better the performance of the mouth guard.

The testing setup included a simplified stainless steel upper dentition mounted at the bottom of a drop tower in an inverted orientation. Each mouth guard was formed to this upper jaw dentition by first placing the mouth guard into water previously heated to 212 degrees for 90 seconds. The mouth guard was removed and placed in cold water for 2 seconds, and then pressed onto the steel upper dentition. This was to simulate the fit of a mouth guard on a typical user. The mouth guards were then cooled to harden the materials. Thereafter, each guard was placed on this inverted upper jaw dentition portion of the testing assembly. The assembly was mounted on top of a piezoelectric force transducer to measure a force-time history. A simplified stainless steel lower dentition mutating the teeth and jaw) was mounted to the falling mass. The falling lower de 11 would represent an uppercut type force hitting the lower jaw and the energy transferring through the mouth guard to the upper jaw and had a mass of 1.94 kg. The height of the dropped mass was increased in 10 cm increments until a certain critical peak force was reached. Peak force was measured and recorded. The results are shown in FIGS. 7A and 7E.

The force data shows the tested embodiment outperformed all comparative examples at every drop height. Shown below in Table 1 are the percent differences (percent higher) of the peak force registered from each testing point of the competitor guards when compared to the testing sample MR2 in accord with the present embodiment. As is evident from this table, the present embodiment MR2 outperformed all comparative examples at all testing levels.

TABLE 1

Impact Testing Results: Percent Difference of Peak Force Transferred

| | | Drop Height (cm) | | | | | |
|---|---|---|---|---|---|---|---|
| | | 10 | 20 | 30 | 40 | 50 | 60 |
| MR2 | Comp Ex. 1 | 123% | 85% | 71% | 60% | 48% | 45% |
| | Comp Ex. 2 | 460% | 377% | 356% | 382% | 438% | 384% |
| | Comp Ex. 3 | 164% | 120% | 112% | 115% | 122% | 142% |
| | Comp. Ex. 4 | 40% | 30% | 13% | 23% | 24% | 25% |

While this invention has been particularly shown and described with reference to exemplary embodiments thereof, the above description should be considered as illustrations of the exemplary embodiments only and are not for purposes of limitation. Therefore, the scope of the invention is defined not by the detailed description of the invention but by the appended claims, and all differences within the scope will be construed as being included in the present invention.

What is claimed is:

1. A mouth guard configured to be fitted to teeth of a user, the mouth guard comprising:

an outer layer that forms a lowermost layer and side walls defining a U-shape;

an insert layer formed of a shock absorbing foam disposed on an upper surface of the outer layer and extending parallel to the lowermost layer between the sidewalls of the outer layer to form a U-shape; and an inner layer formed on the insert layer and extending between the sidewalls of the outer layer, wherein the outer layer is formed of a material harder than the insert layer and the inner layer, and the insert layer is formed of a material softer than the outer layer and the inner layer to absorb forces exerted on the outer layer and the inner layer, wherein the outer layer comprises a thermo-chromic material configured to change color in response to the outer layer reaching a temperature in excess of 100 degrees F., and wherein the thermo-chromic material is configured to change the color from a dark color to a transparent or semitransparent material, and the insert layer is formed of a bright color whereby the bright color is visible through the outer layer when semitransparent due to the temperature in excess of 100 degrees F.

2. The mouth guard according to claim 1, wherein the inner layer is thicker in a bit direction than the outer layer.

3. The mouth guard according to claim 2, wherein the insert layer is thicker than the inner layer and the outer layer in the bit direction.

4. The mouth guard according to claim 3, wherein a thickness of the outer layer is within a range of 1-2 mm, a thickness of the insert layer is within a range of 3.5-4.4 mm, and a thickness of the inner layer is within a range of 3.3-3.8 mm.

5. The mouth guard according to claim 1, wherein the inner layer abuts the outer layer at a front portion of the mouth guard configured to fit front teeth of the user and be exposed through the user's mouth.

6. The mouth guard according to claim 1, wherein the outer layer and the inner layer is formed of an elastomeric polymer.

7. A mouth guard configured to be fitted to teeth of a user, the mouth guard comprising:

an outer layer that forms a lowermost layer and side walls defining a U-shape;

an insert layer formed of a shock absorbing foam disposed on an upper surface of the outer layer and extending parallel to the lowermost layer between the sidewalls of the outer layer to form a U-shape; and an inner layer formed on the insert layer and extending between the sidewalls of the outer layer, wherein the outer layer is formed of a material harder than the insert layer and the inner layer, and the insert layer is formed of a material softer than the outer layer and the inner layer to absorb forces exerted on the outer layer and the inner layer, wherein the outer layer is configured to change from a dark color to a transparent color and has a thickness in a range of 1-1.5 mm along a front portion of one of the sidewalls configured to face opposite the user's teeth, and the inner layer abuts the outer layer inside the front portion, and wherein the insert layer has a bright color, and wherein the bright color and thickness of the front portion are configured to show the bright color when the temperature of the outer layer exceeds a temperature of 100 degrees F.

* * * * *